US012458164B2

(12) United States Patent
Bernstein et al.

(10) Patent No.: US 12,458,164 B2
(45) Date of Patent: Nov. 4, 2025

(54) COLLAPSIBLE ARMS HANGER WITH PINCH AND PULL LOCK WITH OR WITHOUT FOLDING HOOK

(71) Applicant: SJBEE LLC, Hewlett, NY (US)

(72) Inventors: Steven J. Bernstein, Hewlett, NY (US); Leslie S. Blitz, New Hyde Park, NY (US)

(73) Assignee: SJBEE LLC, Hewlett, NY (US)

( * ) Notice: Subject to any disclaimer, the term of this patent is extended or adjusted under 35 U.S.C. 154(b) by 0 days.

(21) Appl. No.: 19/173,690

(22) Filed: Apr. 8, 2025

(65) Prior Publication Data

US 2025/0261777 A1 Aug. 21, 2025

Related U.S. Application Data

(63) Continuation-in-part of application No. 19/057,995, filed on Feb. 20, 2025.

(60) Provisional application No. 63/634,823, filed on Apr. 16, 2024, provisional application No. 63/556,317, filed on Feb. 21, 2024.

(51) Int. Cl.
*A47G 25/40* (2006.01)
*A47G 25/18* (2006.01)

(52) U.S. Cl.
CPC ..... *A47G 25/4023* (2013.01); *A47G 25/186* (2013.01)

(58) Field of Classification Search
CPC ..... A47G 25/4015; A47G 25/4023; A47G 25/403; A47G 25/4038; A47G 25/4061
USPC ..... 223/89, 90, 94
See application file for complete search history.

(56) References Cited

U.S. PATENT DOCUMENTS

| | | | | |
|---|---|---|---|---|
| 2,716,513 | A * | 8/1955 | Braunstein | A47G 25/4023 223/94 |
| 2,926,823 | A * | 3/1960 | Weiser | A47G 25/4023 D6/318 |
| 7,243,823 | B2 * | 7/2007 | Cresap | A47G 25/4023 223/89 |
| 8,814,013 | B2 * | 8/2014 | Almeida Levi | A47G 25/4023 223/94 |
| 9,655,466 | B1 | 5/2017 | Bernstein et al. | |
| 10,959,558 | B1 | 3/2021 | Bernstein et al. | |

(Continued)

FOREIGN PATENT DOCUMENTS

KR 101761743 B1 * 7/2017 ..... A47G 25/4038

*Primary Examiner* — Nathan E Durham
(74) *Attorney, Agent, or Firm* — OSTROLENK FABER LLP

(57) ABSTRACT

A garment hanger with a hook either metal or plastic that moves between a substantially vertical position and a substantially horizontal position or also remains in a stationary upright position. The body of the hanger has arms that collapse and move between a substantially vertical position and a substantially horizontal position. Secondary "locking" system on arms and bodies to ensure the arms remain in a horizontal position without folding unintentionally by being interlocked with each other in a manner that requires a user to manually release the interlocking through use of a lock releasing lever. This allows easier insertion or removal of hanger in closed neck garment. When both arms and hook are folded or collapsed this creates footprint reduction of hanger, creating space savings in packaging and transport. A size tab can be fitted to the hanger.

15 Claims, 20 Drawing Sheets

(56) References Cited

U.S. PATENT DOCUMENTS

| | | | | |
|---|---|---|---|---|
| 2006/0054646 | A1* | 3/2006 | Nathanmanna .... | A47G 25/4023 223/89 |
| 2007/0158374 | A1* | 7/2007 | Chan ..... | A47G 25/4023 223/85 |
| 2011/0284597 | A1* | 11/2011 | Kaleta ..... | A47G 25/4023 223/85 |

* cited by examiner

COLLAPSIBLE ARMS HANGER WITH PINCH AND PULL LOCK WITH OR WITHOUT FOLDING HOOK

CROSS-REFERENCE TO RELATED APPLICATIONS

The present patent application is a continuation-in-part of U.S. patent application Ser. No. 19/057,995, filed on Feb. 20, 2025, by Steven J. Bernstein and Leslie S. Blitz, entitled "COLLAPSIBLE ARMS HANGER WITH PINCH AND PULL LOCK WITH OR WITHOUT FOLDING HOOK", which claims the benefit of and priority to U.S. Provisional Patent Application Nos. 63/634,823, filed on Apr. 16, 2024, entitled "COLLAPSIBLE ARMS HANGER WITH PINCH AND PULL LOCK WITH OR WITHOUT FOLDING HOOK" and 63/556,317, filed on Feb. 21, 2024, entitled "COLLAPSIBLE ARMS HANGER WITH OR WITHOUT FOLDING HOOK". The entire contents of each of the patent applications listed above are incorporated herein by reference.

BACKGROUND OF THE INVENTION

Garment hangers have been around for hundreds of years. Modern day retail use garment hangers have many packaging and travel requirements and specifications intended to increase efficiency in the supplier to retailer pipeline by minimizing order to sales floor or ecommerce shipment time. Many garments are manufactured all over the world and then shipped to United States (or other countries) pre-hung as a "garment on hanger" from the originating garment manufacturing location. To save time and expense at the retail level the garment is placed on the hanger at the point of garment manufacturing and placed into a shipping box or container. Upon delivery to the retailer location, the retailer must remove the "garment on hanger" from the box or container and hang appropriately in distribution center for e commerce shipment or further shipment to an individual store.

Present day Omni Channel process dictates if the garment goes directly to the sales floor, the hanger will stay on the garment, if to be shipped in ecommerce packaging there is a need for the hanger to be easily removed without harming the hanger or unbuttoning the garment to remove the hanger. Since the retailer or the garment manufacturer does not always know, which apparel will go to the greater need either brick and mortar store or ecommerce, the need for a garment hanger that can be used in both channels without being changed is required.

This invention relates to the need for an individual hanger to be able to be used both at retail level and ecommerce shipments due to the nature of the folding hook and collapsible arms. There have been many examples of collapsible hangers over the years but never one that appears to meet all the current retail or GS1 specifications for weight of garment and silhouette. This invention improves upon the hangers of U.S. Pat. No. 10,959,558 hanger with folding hook that folds and arms that collapse when needed or remain solid when used as a commercial hanger holding garments up to two- and one-half pounds without folding unintentionally.

Today's dimensional packaging shipping costs have made for the appreciation of smaller shipping boxes saving cost based on the dimension of the box. A smaller footprint of hanger when collapsed will allow for smaller shipping cartons.

SUMMARY OF THE INVENTION

The foregoing and other objects of the invention are realized in accordance with the disclosure herein with a garment hanger, comprising: a hanger body having a central neck to which a hanger hook is connected, and hanger arms removably connectible to said hanger body such that said hanger arms are collapsible to a substantially vertical position permitting the hanger to be removed from or inserted into a garment through a neck opening of the garment, without having to unbutton said garment for such removal; said hanger body comprising openings at opposite ends of said central neck, and adjacent each said opening, an arm-motion arrester comprising a projection located outside the opening and projecting outwardly; said hanger arms including a first hanger arm and a second hanger arm, each hanger arm being connectible to and pivotably movable in a respective one of said openings, in configurations that enable said hanger arms to be held and fixed in a standard horizontal position and selectively collapsed by pivoting said hanger arms with respect to said central neck to assume said substantially vertical position relative to said neck portion, said first and second hanger arms being interchangeable such that said hanger arms can be attached to said hanger body at opposite ends thereof, and said hanger arms being removable from said openings; and each hanger arm being molded to include a flexible lock including a pinchable or pullable handle and a locking region that is so located on the hanger arm that rotation of the hanger arm from its extended to said collapsed position is prevented when the locking region on the arm meets and engages with the projection located on the arm-motion arrester of the hanger body, and such that pinching or pulling of the handle of the flexible lock is required to release the engagement between the flexible lock and said projection to allow the hanger arm to be moved to its collapsed position.

Preferably, the described hanger is such that also includes one or more of the following: each of the hanger body, the first hanger arm and the second hanger arm is formed as and of a molded plastic material; said hanger arms are identical in structure whether used on either side of said hanger body; the pullable handle extends below a lower edge of the hanger arm so as to be easily locatable by a user's fingers even when concealed from view by the garment; the arm-motion arrester and the flexible lock have mutual surfaces that abut each other in the locked, extended orientation of the hanger arms; the arm-motion arrester defines a nestling space that is shaped to receive therein a corresponding pointed end of the flexible lock in the locked, extended orientation of the hanger arms; the hanger arms are configured to remain in their extended orientations even when supporting garment weights of two pounds; and/or said hanger hook is pivotably connected to said hanger neck and moveable to either substantially vertical or horizontal positions.

In another preferred embodiment, the garment hanger, comprises: a hanger body having a central neck with a configuration to receive a hanger hook, and hanger arms connectible to said central neck such that said hanger arms are rotatable to assume an extended position suitable for supporting a garment thereon and a collapsed position permitting the hanger to be removed from or inserted into a garment through a neck opening of the garment, without having to unbutton said garment for such removal; said hanger body comprising a pair of pivot openings at opposite ends of said central neck, and a user-actuatable, resiliently movable push button located generally between said pivot openings; said hanger arms including a first hanger arm and a second hanger arm, each hanger arm being connectible to and pivotably movable in a respective one of said pivot openings, in configurations that enable said hanger arms to be selectively moved between said extended and collapsed positions; and each hanger arm being molded to include a nub sized to snuggly fit and rotate within one of said pivot opening and a hooking finger configured to inter-engage said push button in a manner that locks said hanger arm in the extended position and being releasable upon actuation of said push button.

Preferably, in the foregoing embodiment, the nub comprises locking portions that engage the pivot opening in a manner that locks the nub to the central neck. The locking portions comprise a plurality of locking fingers. Each of the hanger arms is formed of a single molded plastic piece. Each of said hanger arms comprises a stop that limits the rotational movement range thereof relative to said central neck. The central neck comprises a channel for movement of said stop of said hanger arm therein. The hanger arms are configured to remain in their extended orientations even when supporting garment weights of two pounds. Also, the hooking finger of the hanger arms comprises a tip of gradually reducing thickness that is configured to engage an arcuate portion of said push button, to displace it and enable the hooking finger to engage a bottom edge of the push button to thereby lock the hanger arm in the extended orientation.

DETAILED DESCRIPTION OF THE DRAWINGS

Figure 1A:
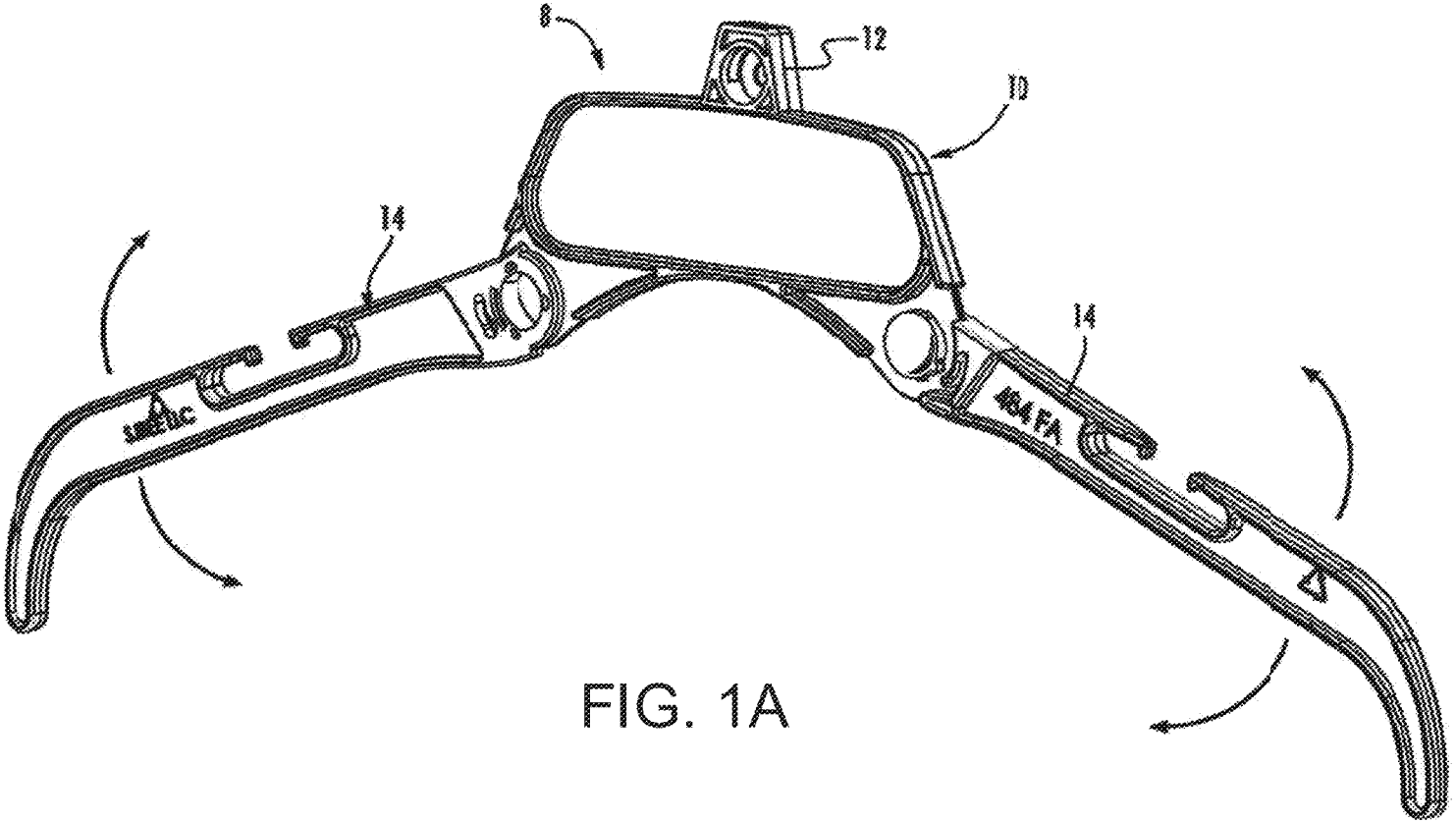
FIG. 1A is a perspective view of the hanger of the present invention with collapsible arms and folding metal hook boss.
Figure 3:
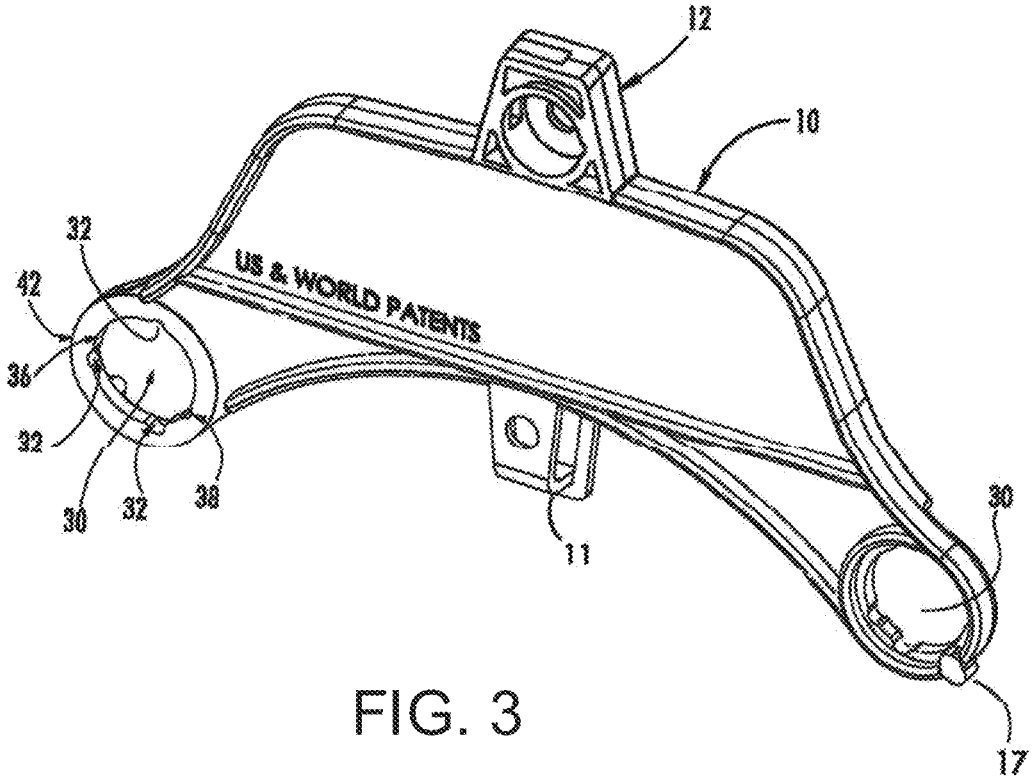
FIG. 3 is a front perspective view of the central neck portion of the hanger of this invention.

Referring to FIG. 1A, a hanger 8 is shown having central neck 10 with metal hook and SOHS (secure over the hook sizer) sizer receiver mount 12 on top thereof. The hanger is preferably of an "I" beam construction. Hanger 8 is shown as a full hanger with the hanger arms 14 in the upright open standard horizontal position. This design is not limited to an "I" beam construction. In one preferred embodiment (FIG. 1C and FIG. 3) central neck 10 includes a coordinate loop 11 for receiving a second similar hanger or it could be for an entirely different hanger silhouette.

In accordance with this invention, arms 14 are pivotably connected to the central neck 10 at pivots 16 (FIG. 1B) located on either side at the bottom of central neck 10.

Figure 1B:
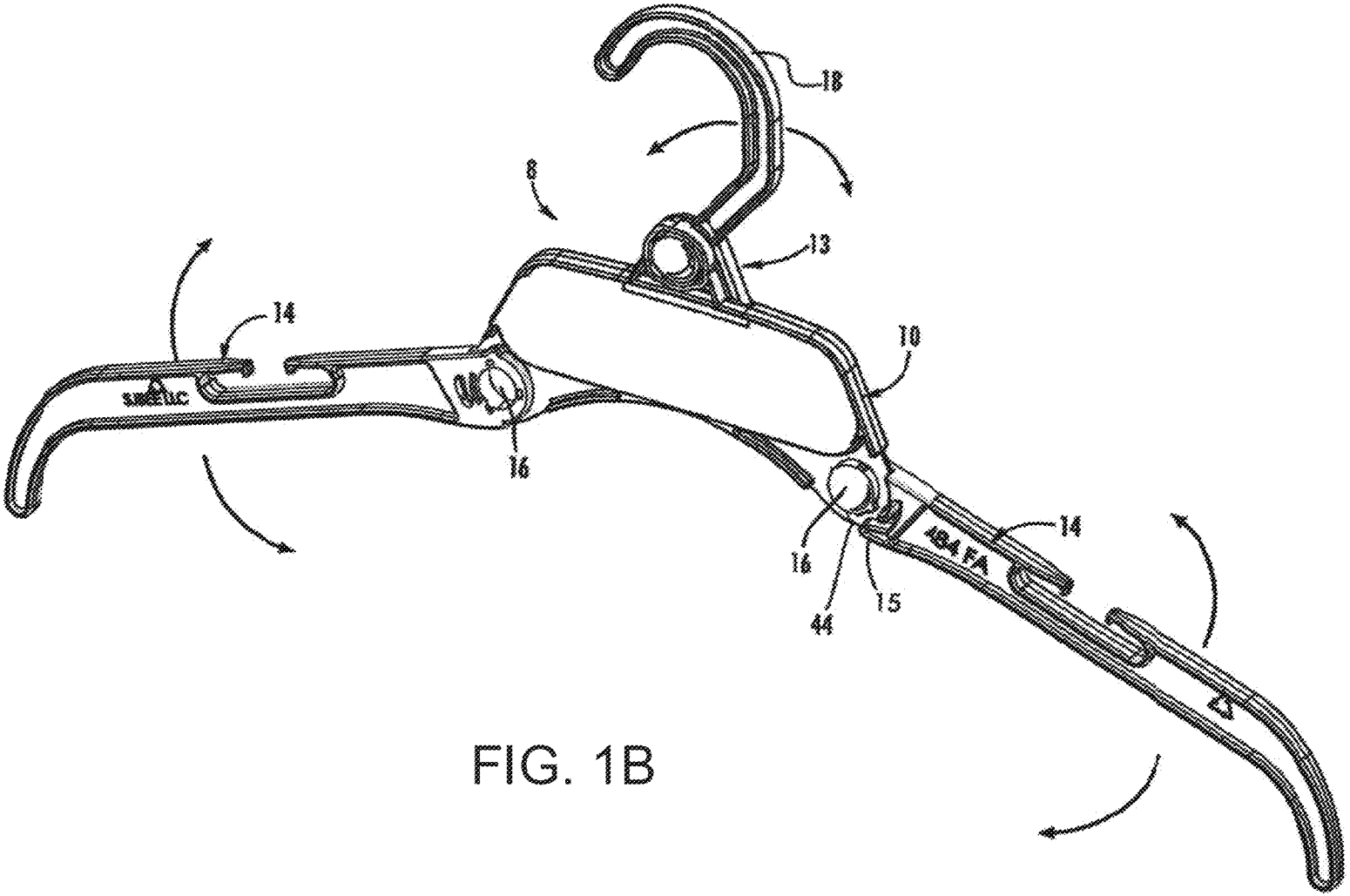
FIG. 1B is a perspective view similar to FIG. 1*a* with the collapsible arms and a plastic hook.

FIG. 1B shows hanger 8 similar to FIG. 1A except that folding plastic hook 18 is pivotably connected to mount 12 and is added to central neck 10 with plastic hook sizer mount 13 formed as an I beam construction.

Figure 1C:
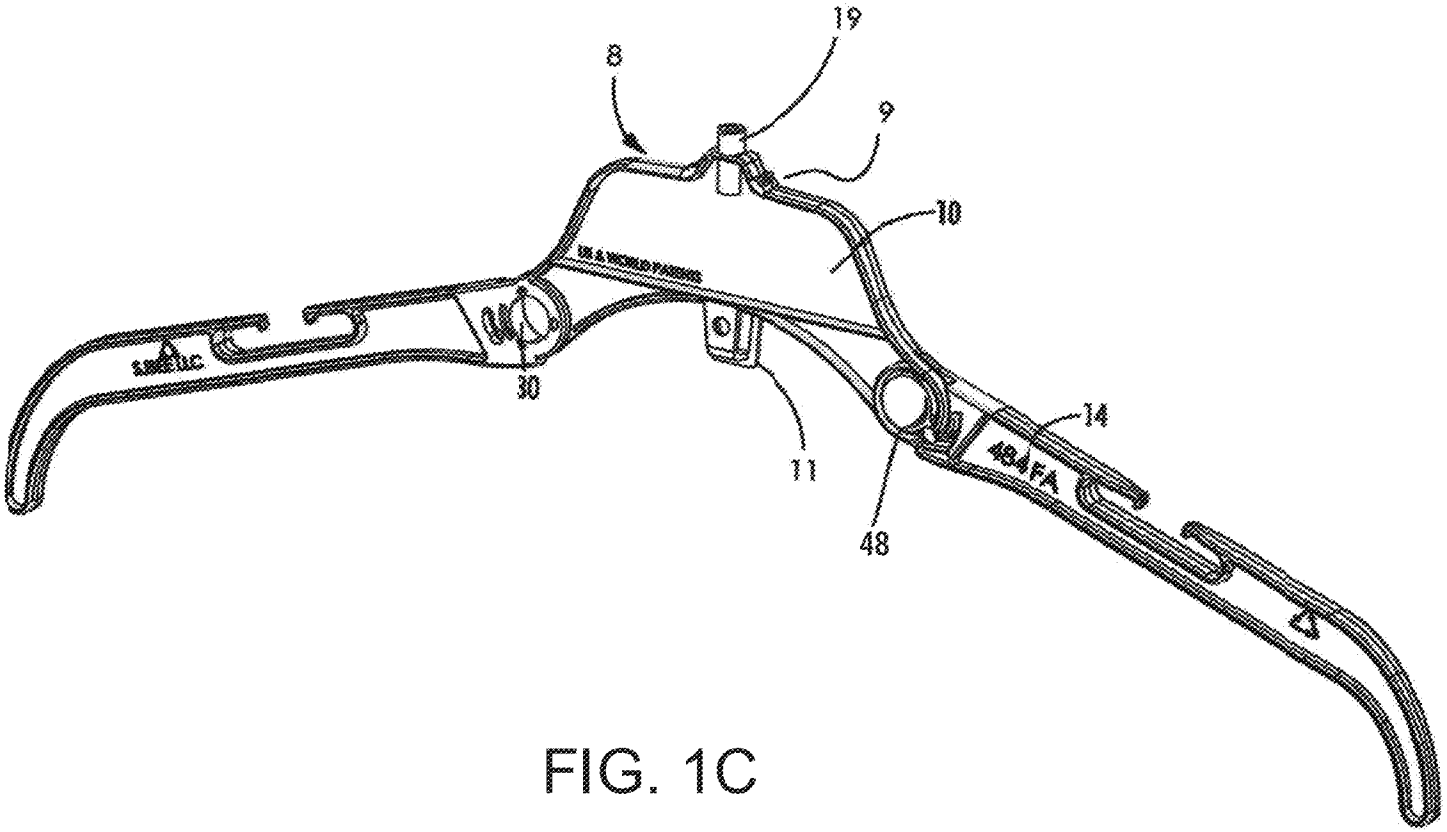
FIG. 1C is a perspective view similar to FIG. 1A and FIG. 1B with non-folding hook with collapsible arms and SOHS sizer mount.

FIG. 1C shows hanger 8 similar to FIG. 1A except with metal hook boss 19 in place for non-foldable hook and 9 steps for SOHS (secure over the hook sizer) size identity tab and coordinate loop 11 is shown.

Figure 2A:
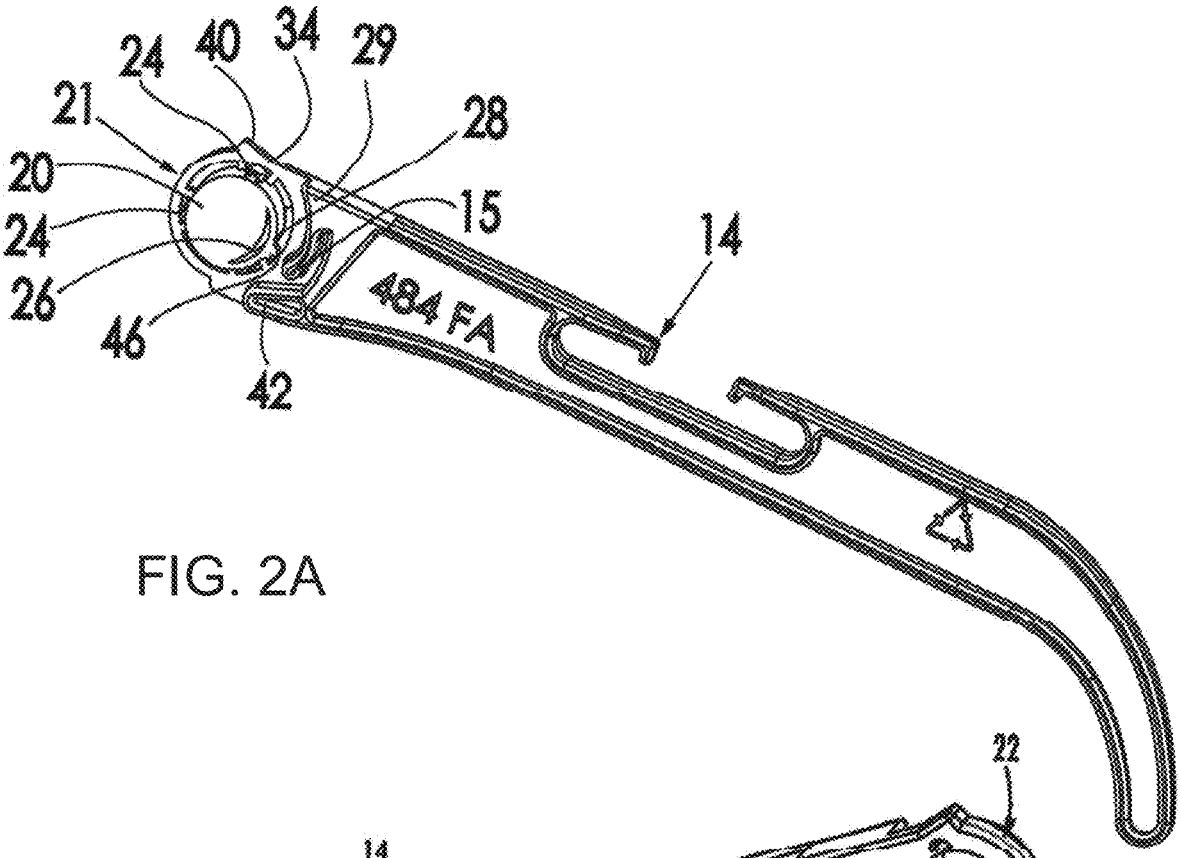
FIG. 2A is a front perspective view of collapsible arm.
Figure 2B:
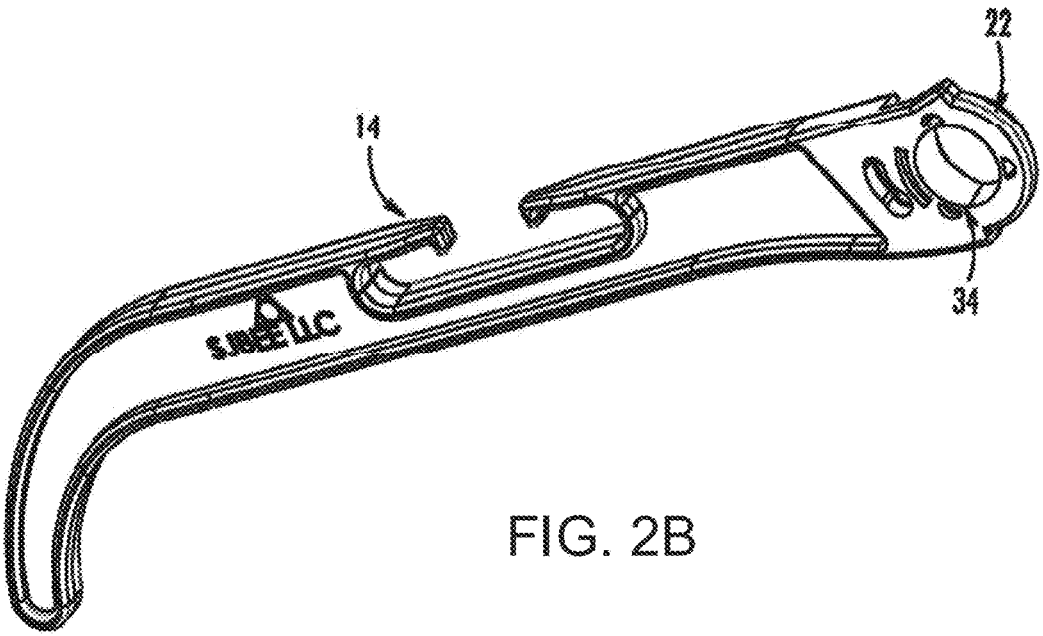
FIG. 2B is a rear perspective view of the collapsible arm.

FIGS. 2A and 2B are front and rear perspective views of arm 14 which can be used as right or left arms for the hangers. Hanger arm 14 has a substantially circular cantilevered projection 21 at an inner end 22 with three tabs 24 to hold arms to the central neck and hanger body formed on the radial surface 26 of the circular projection 21 and cantilevered positions nub 28 projecting from radial surface 26.

The cantilevered nub 28 and its circular position are also shown in U.S. Pat. Nos. 9,655,466 and 10,959,558 ('466 and '558 having the same inventors as for the present invention). FIG. 2A shows the addition of 15 flexible stabilization mechanism which interacts with stabilizing nub 17 shown in FIG. 3. The contents of U.S. Pat. Nos. 9,655,466 and 10,959,558 are incorporated herein by reference. Additionally, the attachment between circular projection 21 and nub 28 of this invention are substantially similar to the mechanism of FIGS. 3A and 3B of the '466 patent. The '466 patent describes a cantilevered projection system as well as a closed projection system with respective nubs to achieve pivot and removal functions as are achieved in this invention. Either closed or cantilevered system can be used with the present invention.

FIG. 2A shows the introduction of a closed cantilever 26 and open flexible stabilization mechanism 15 which provides more stability to the hanger when in the open arm position. Nub 17 (FIG. 3) serves as an additional protrusion to hold the arm in open position when flexible stabilization mechanism 15 passes over it.

Projection 21 and retainer tab 24 locks into hole 30. Retainer tabs 24 align with recesses 32 for easy assembly and friction holding of the arm in hole 30. Back bearing surface 34 presses against perimeter 36 around hole 30 for stability for the complete assembly. Positioning nub 28 is attached to the cantilevered flexible member 29 and allows positioning nub 28 to align with recess 38 (FIG. 3) to position and hold the arms to be in the standard horizontal position. Upper arm stop 40 prevents the arm 14 from being positioned above the horizontal plane. Lower arm stop 42 prevents the arm 14 from being positioned beyond the vertical plane when butting up against central head arm stop 44 (FIG. 1B).

Figure 4:
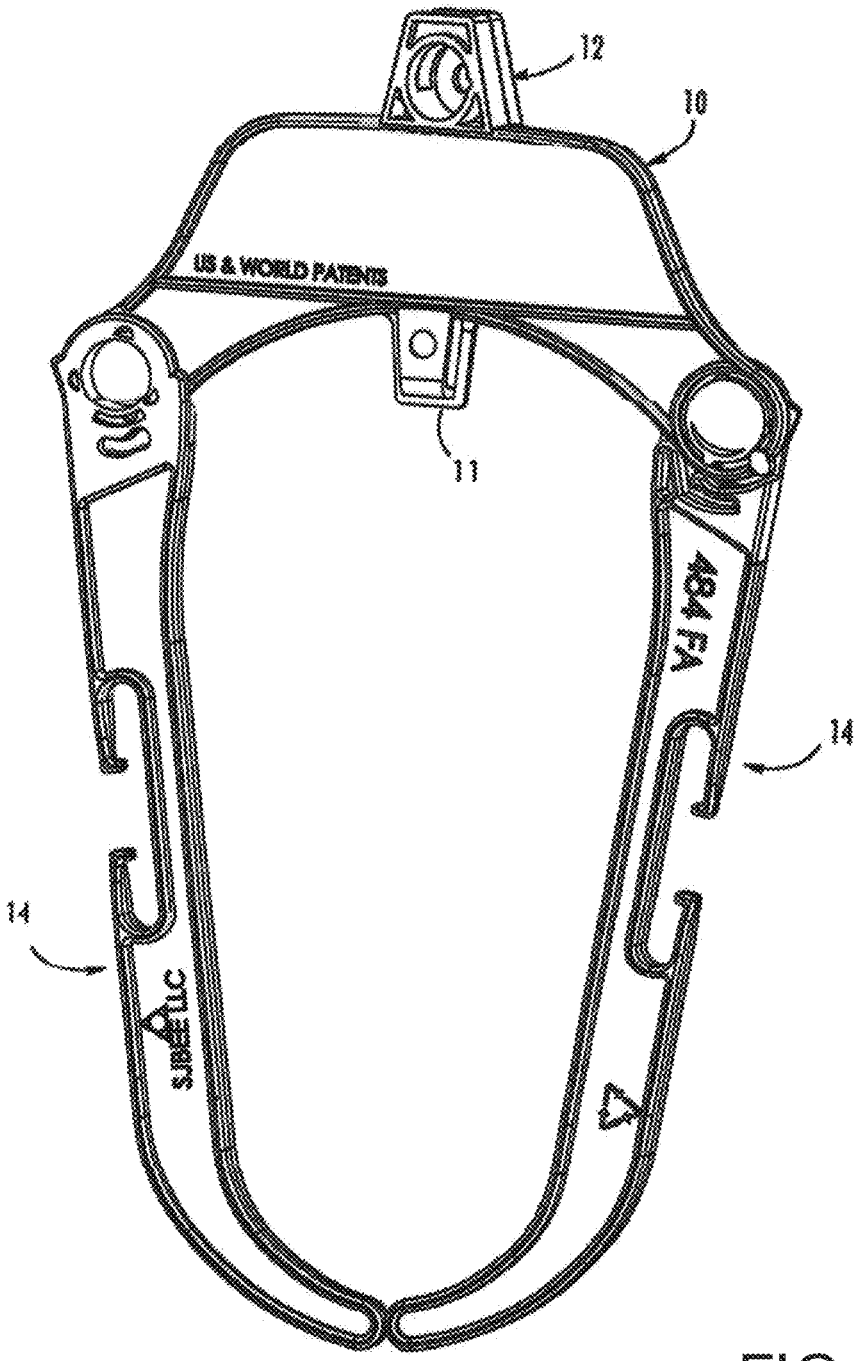
FIG. 4 is a perspective view of the hanger arms in the closed position.

FIG. 1A, which is a complete assembled hanger with no hook shown, shows the pivotable arms 14 pivoted into the upright horizontal position and functions as a conventional garment hanger for supporting and displaying a garment. However when the arms 14 need to be collapsed to remove or insert into a buttoned or closed neck garment as shown in FIG. 4 the cantilevered hangers arms can be collapsed by pressing down on the arms which forces nub 28 of the cantilever member 29 and flexible stabilization mechanism 15 to be free to rotate on projection 21. Collapsible arms 14 employ a locking mechanism that allows for the arms to remain upright (horizontal) and "locked" into position for display but maybe easily folded or collapsed when they need to remove them form a closed neck garment or buttoned neck garment is required. The simplicity of the pivotable movement of the arms using nub 28 and 17 releasing it form the locking position will be cost effective to manufacturers, easy to assemble and simple for pivoting the locking arm 14 in the upright or folded position.

As discussed above the collapsed state of the hanger provides a reduced footprint for the hanger creating space savings in packaging and transport and the inclusion of the flexible stabilization mechanism 15 and stabilizing nub 17 allow for heavier weight garments. In order to save time and expense at the retail distribution center level, the hanger can either remain as a conventional hanger or the arm 14 can be collapsed for easy removal when hanger is not wanted in e-commerce use or when looking to save space in the dimensional packaging reducing the footprint of box and space required in shipping.

Figure 5:
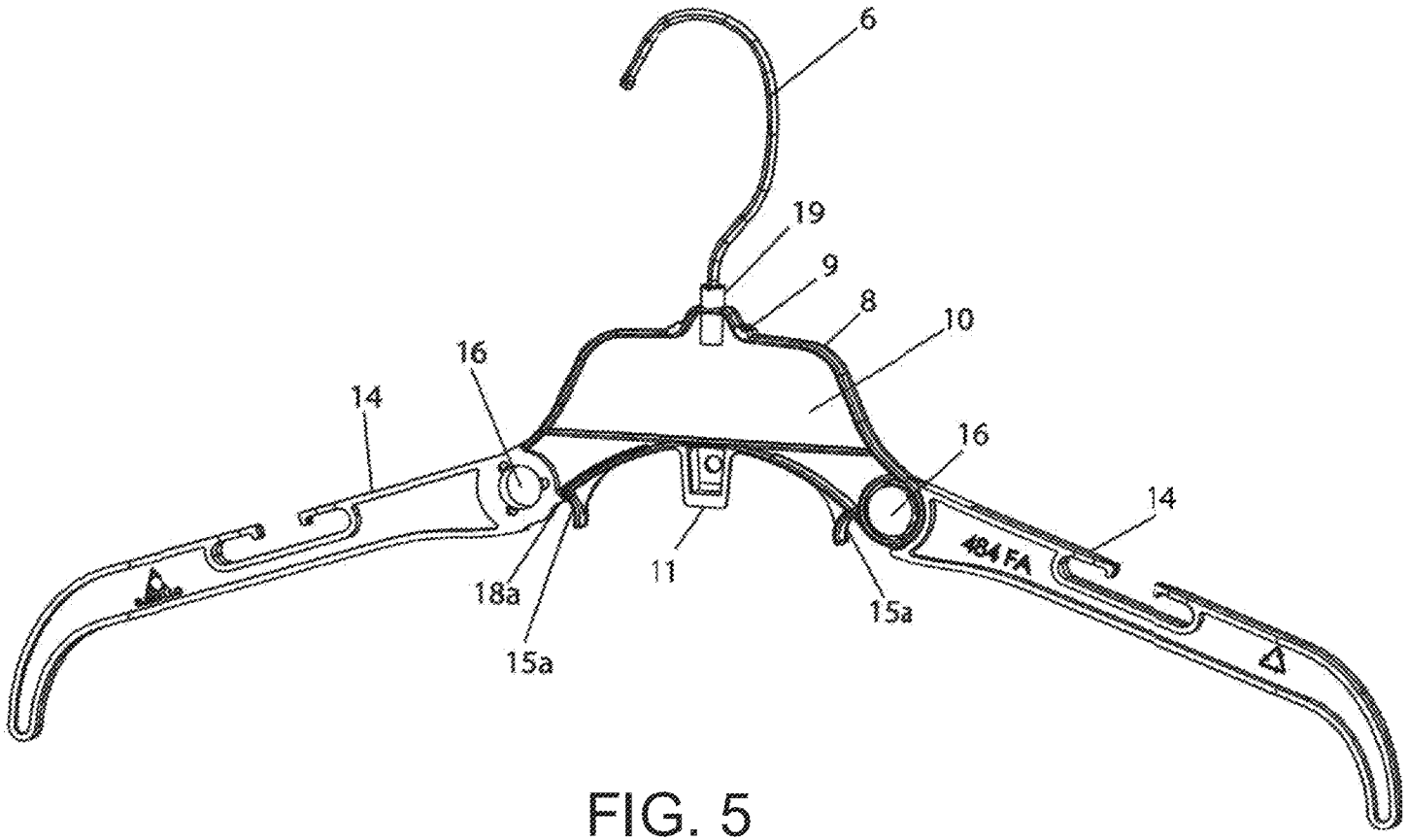
FIG. 5 is a perspective view of the pull in lock hanger of the present invention with collapsible arms and metal hook boss.

Referring to FIG. 5, hanger 8 is shown having central neck 10 with metal hook boss 19 and SOHS (secure over the hook sizer) sizer receiver mount 9 on side thereof. The hanger is preferably of an I-beam construction. Hanger is shown as a full hanger with hanger body 8 and the hanger arms 14 in the upright open standard horizontal position. This design is not limited to an I-beam construction. In one preferred embodiment central neck 10 includes a coordinate loop 11 for receiving a second similar hanger or it could be for an entirely different hanger silhouette.

Figure 8:
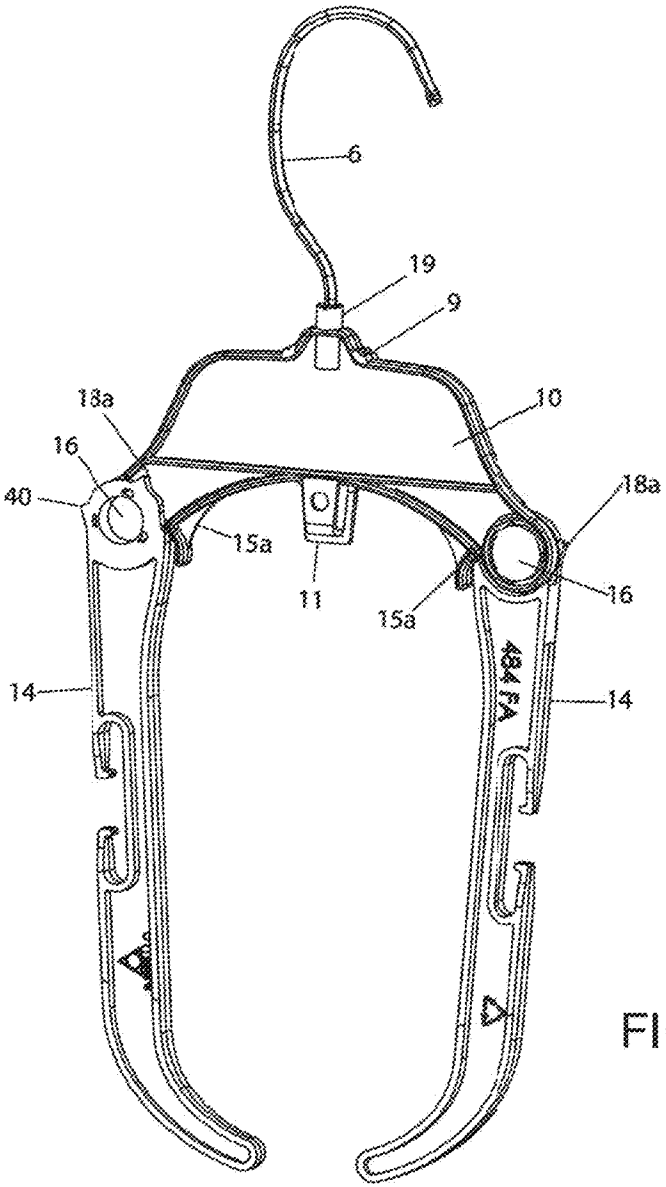
FIG. 8 is a perspective view of the hanger arms in the closed position.

In accordance with this invention, arms 14 are pivotably connected to the central neck 10 at pivots 16 (FIG. 5) located on either side at the bottom of central neck 10. Here can be seen flexible pull in lock 15A which when pulled in releases lock against arm stop 18A to collapse. FIG. 5, which is a complete assembled hanger, shows the pivotable arms 14 pivoted into the upright horizontal position and functions as a conventional garment hanger for supporting and displaying a garment. However, when the arms 14 need to be collapsed to remove or insert into a buttoned or closed neck garment as shown in FIG. 8 the cantilevered hangers arms can be collapsed by pulling inwards on flexible pull in lock 15A which forces flexible pull in lock 15A to be free from arm stop 18A and to rotate on pivot 16. Collapsible arms 14 employ a locking mechanism that allows for the arms to remain upright (horizontal) and "locked" into position for display but maybe easily folded or collapsed when they need to remove them form a closed neck garment or buttoned neck garment is required. The simplicity of the pivotable movement of the arms using flexible pull in lock 15A and releasing it form the locking position will be cost effective to manufacturers, easy to assemble and simple for pivoting the locking arm 14 in the upright or folded position. Also shown in FIG. 5 is flexible pull in lock 15A when pulled away from body releases the hold on arm stops 18A.

Figure 6:
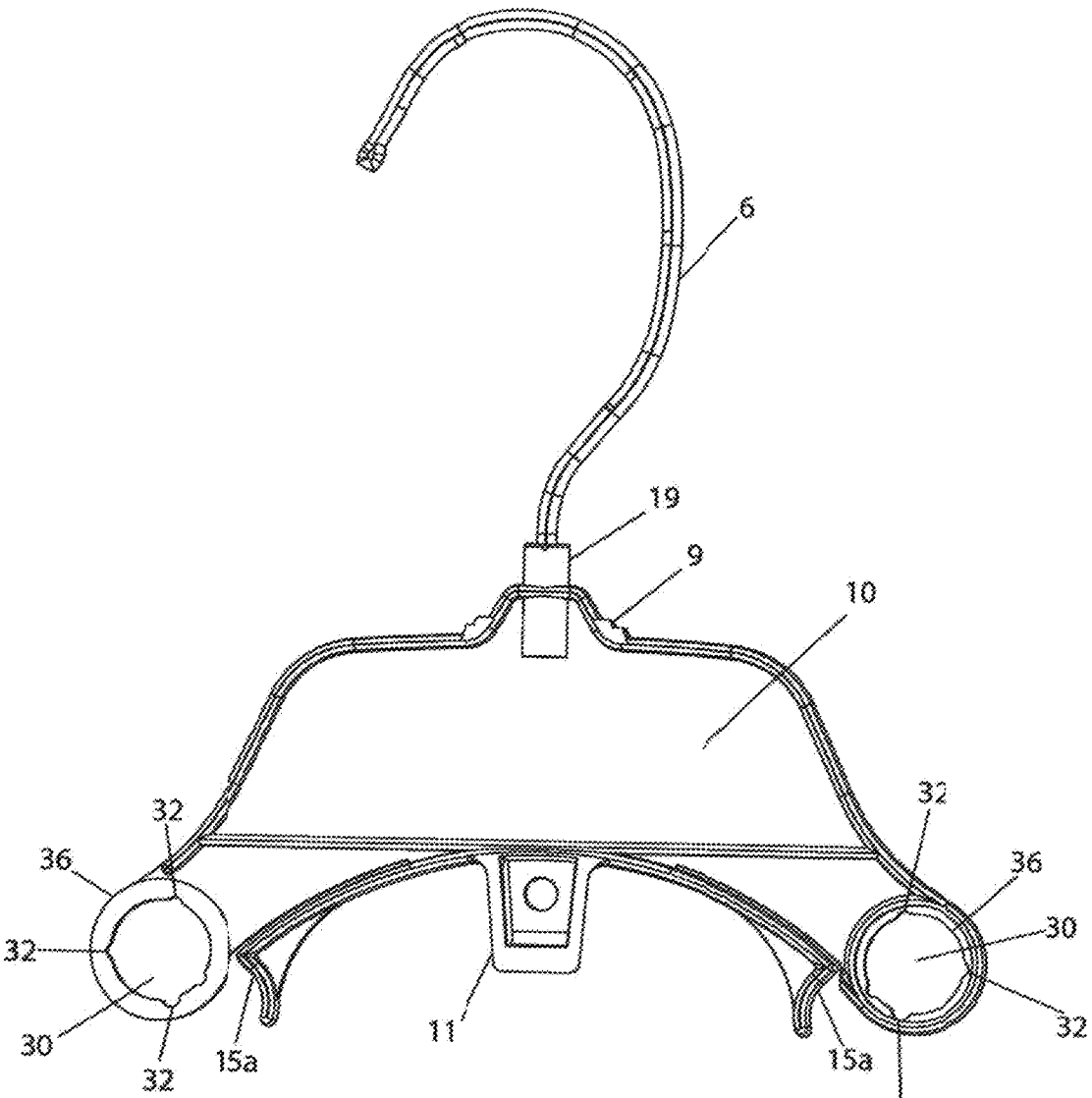
FIG. 6 is a perspective view of hanger body and neck.

FIG. 6 is a front perspective of hanger body 8.

Figure 7:
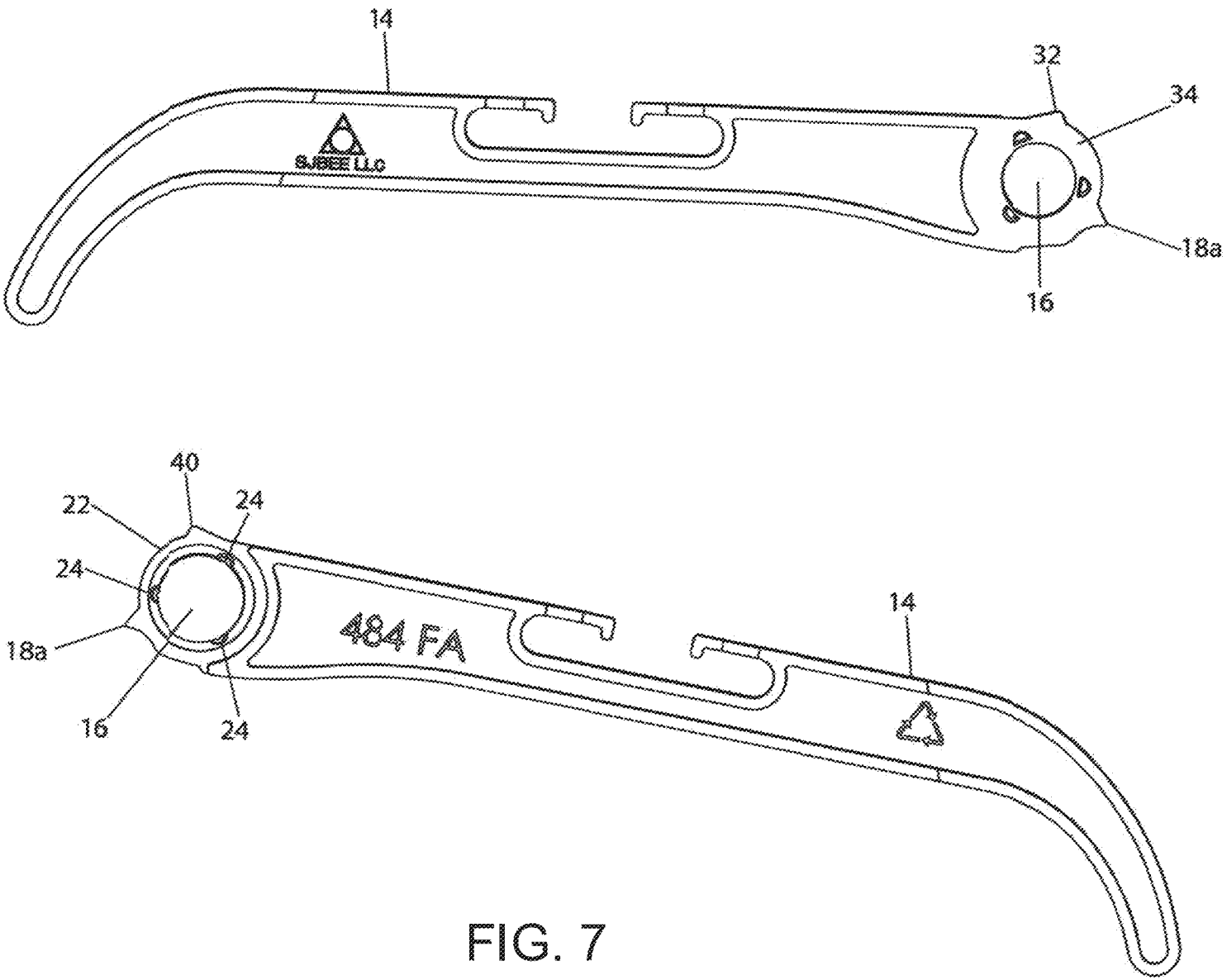
FIG. 7 is a front and back perspective view of the collapsible arms.

FIG. 7 are front and back perspective views of arm 14 which can be used as right or left arms for the hangers. Hanger arm 14 has a substantially circular inner end of arm 22 with three retainer tabs 24 to hold arms to the central neck and hanger body formed on the back bearing surface 34.

FIG. 8 shows the "collapsed" version of the arms.

As discussed above the collapsed state of the hanger provides a reduced footprint for the hanger creating space savings in packaging and transport and the inclusion of the flexible pull in lock 15A and arm stop 18A allow for heavier weight garments. In order to save time and expense at the retail distribution center level, the hanger can either remain as a conventional hanger or the arm 14 can be collapsed for easy removal when hanger is not wanted in e-commerce use or when looking to save space in the dimensional packaging reducing the footprint of box and space required in shipping.

Figure 9:
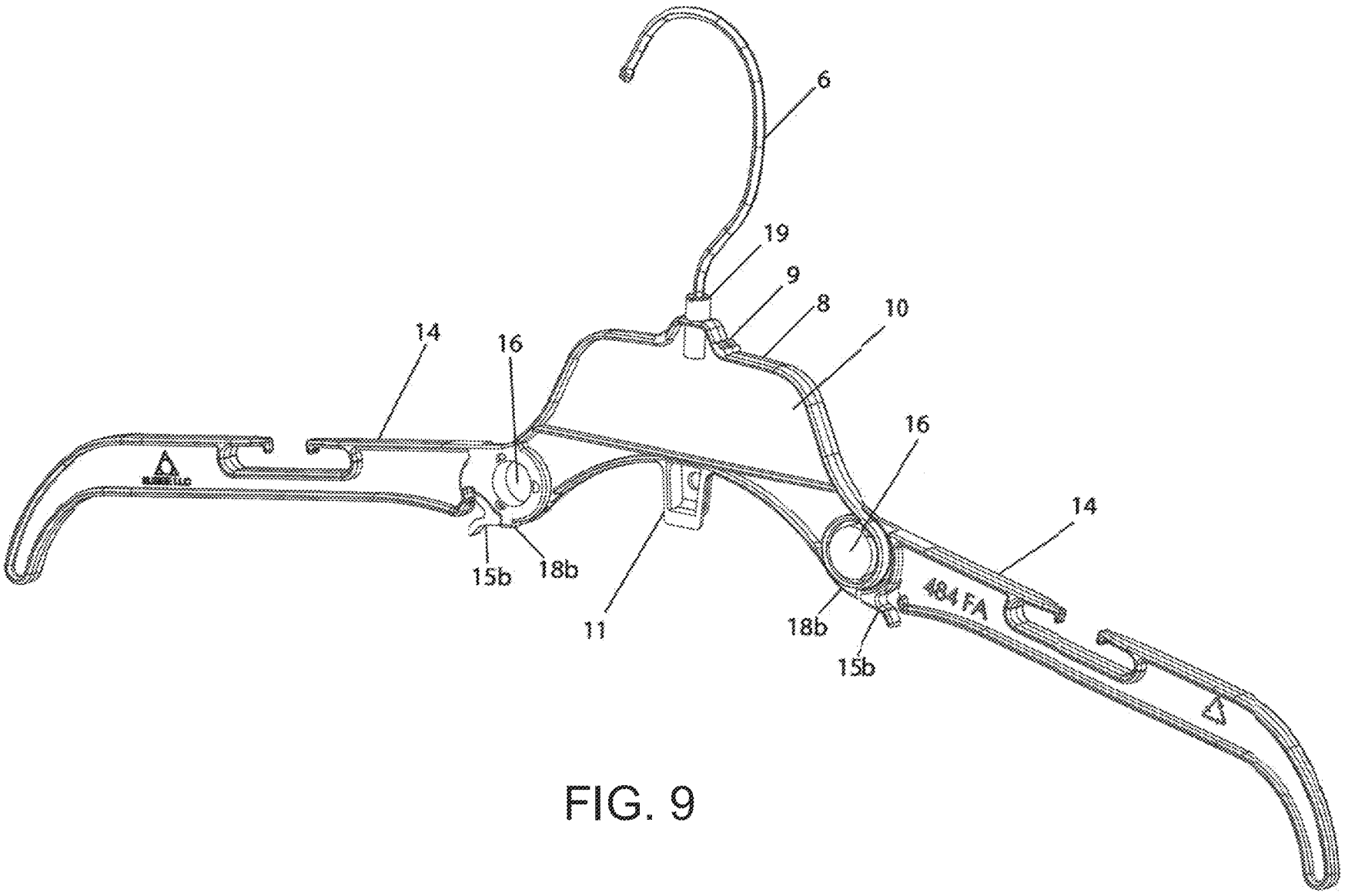
FIG. 9 is a perspective view of the pinch lock hanger of the present invention with collapsible arms and metal hook boss.

Referring to FIG. 9, hanger 8 is shown having central neck 10 with metal hook boss 19 and SOHS (secure over the hook sizer) sizer receiver mount 9 on side thereof. The hanger is preferably of an "I" beam construction. Hanger is shown as a full hanger with hanger body 8 and the hanger arms 14 in the upright open standard horizontal position. This design is not limited to an I-beam construction. In one preferred embodiment central neck 10 includes a coordinate loop 11 for receiving a second similar hanger or it could be for an entirely different hanger silhouette.

Figure 10:
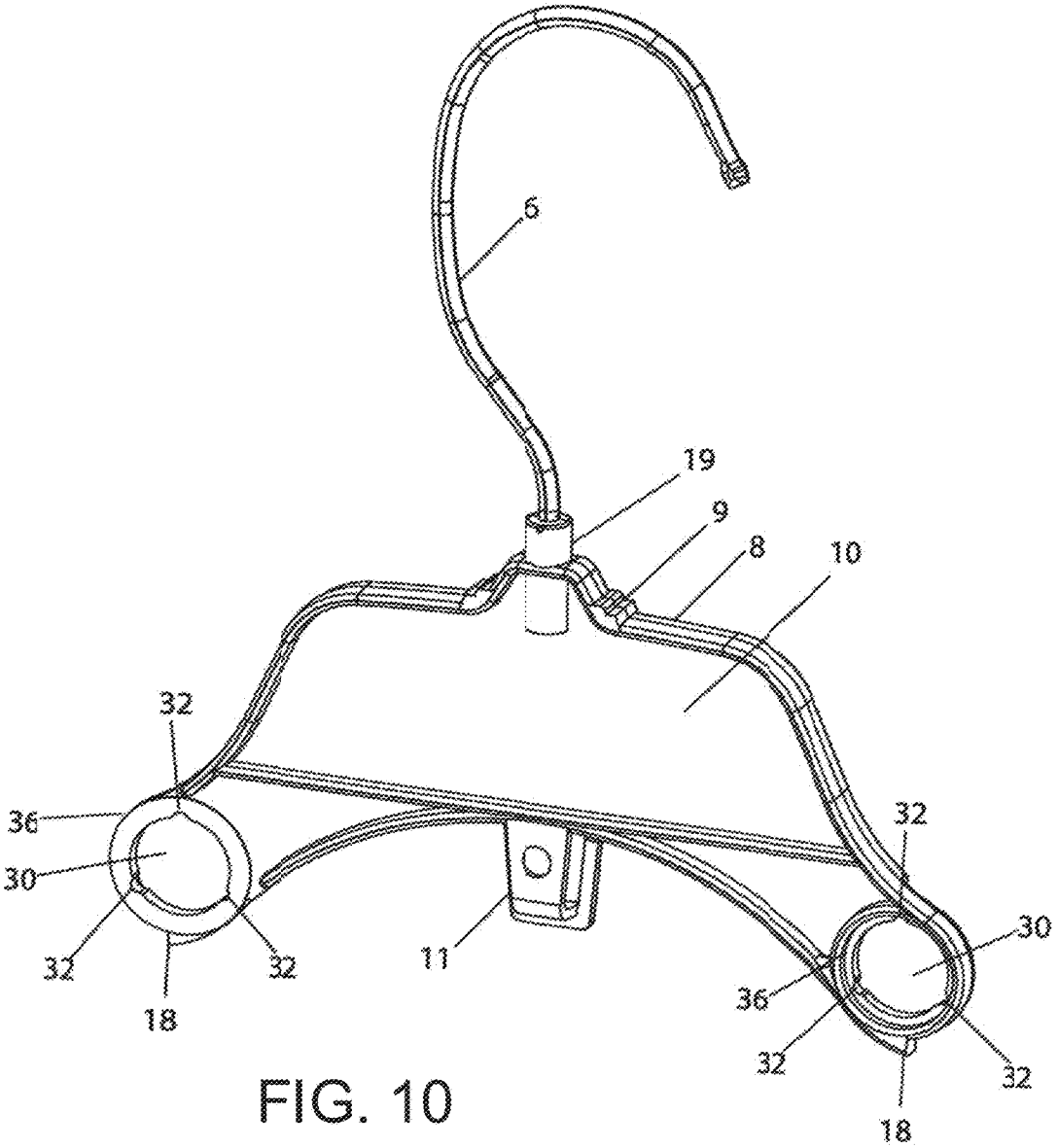
FIG. 10 is a perspective view of hanger body and neck.
Figure 12:
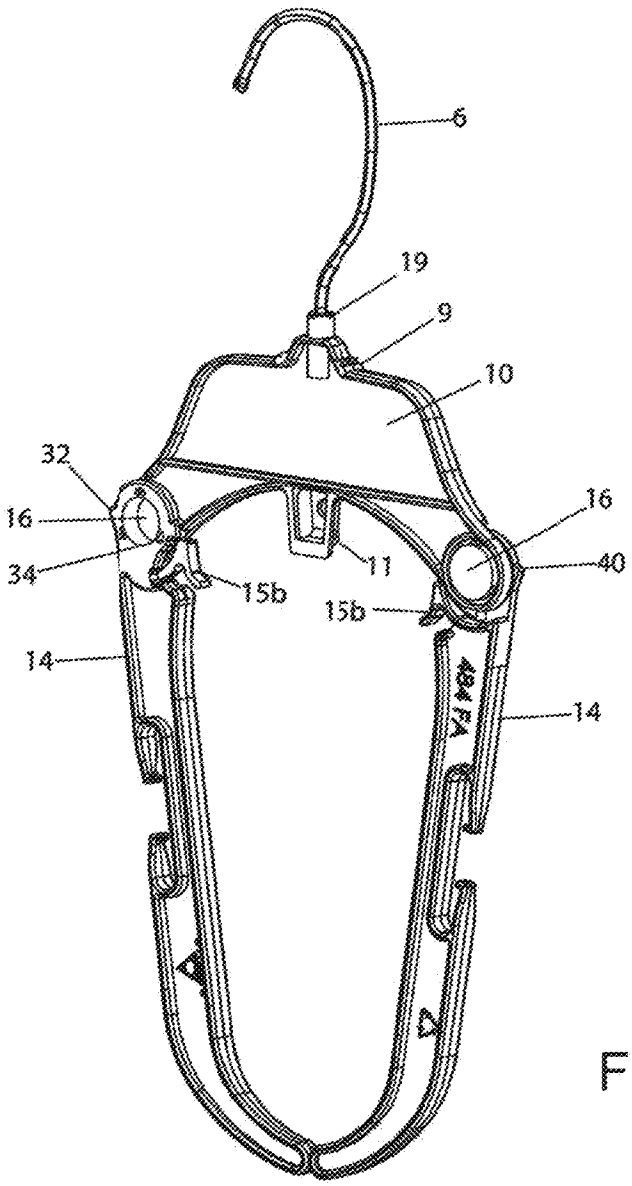
FIG. 12 is a perspective view of the hanger arms in the closed position.

In accordance with this invention, arms 14 are pivotably connected to the central neck 10 at pivots 16 (FIG. 9) located on either side at the bottom of central neck 10. Here can be seen flexible pinchable lock 15B which when pinched releases lock on arm stop 18B to collapse. FIG. 9, which is a complete assembled hanger, shows the pivotable arms 14 pivoted into the upright horizontal position and functions as a conventional garment hanger for supporting and displaying a garment. However, when the arms 14 need to be collapsed to remove or insert into a buttoned or closed neck garment as shown in FIG. 12 the cantilevered hangers arms can be collapsed by pinching flexible pinchable lock 15B which forces flexible pinchable lock 15B to be free to rotate on pivot 16. Collapsible arms 14 employ a locking mechanism that allows for the arms to remain upright (horizontal) and "locked" into position for display but maybe easily folded or collapsed when they need to remove them form a closed neck garment or buttoned neck garment is required. The simplicity of the pivotable movement of the arms using flexible pinchable lock 15B and releasing it from the locking position will be cost effective to manufacturers, easy to assemble and simple for pivoting the locking arm 14 in the upright or folded position. FIG. 10 is a front perspective of hanger body 8.

Figure 11:
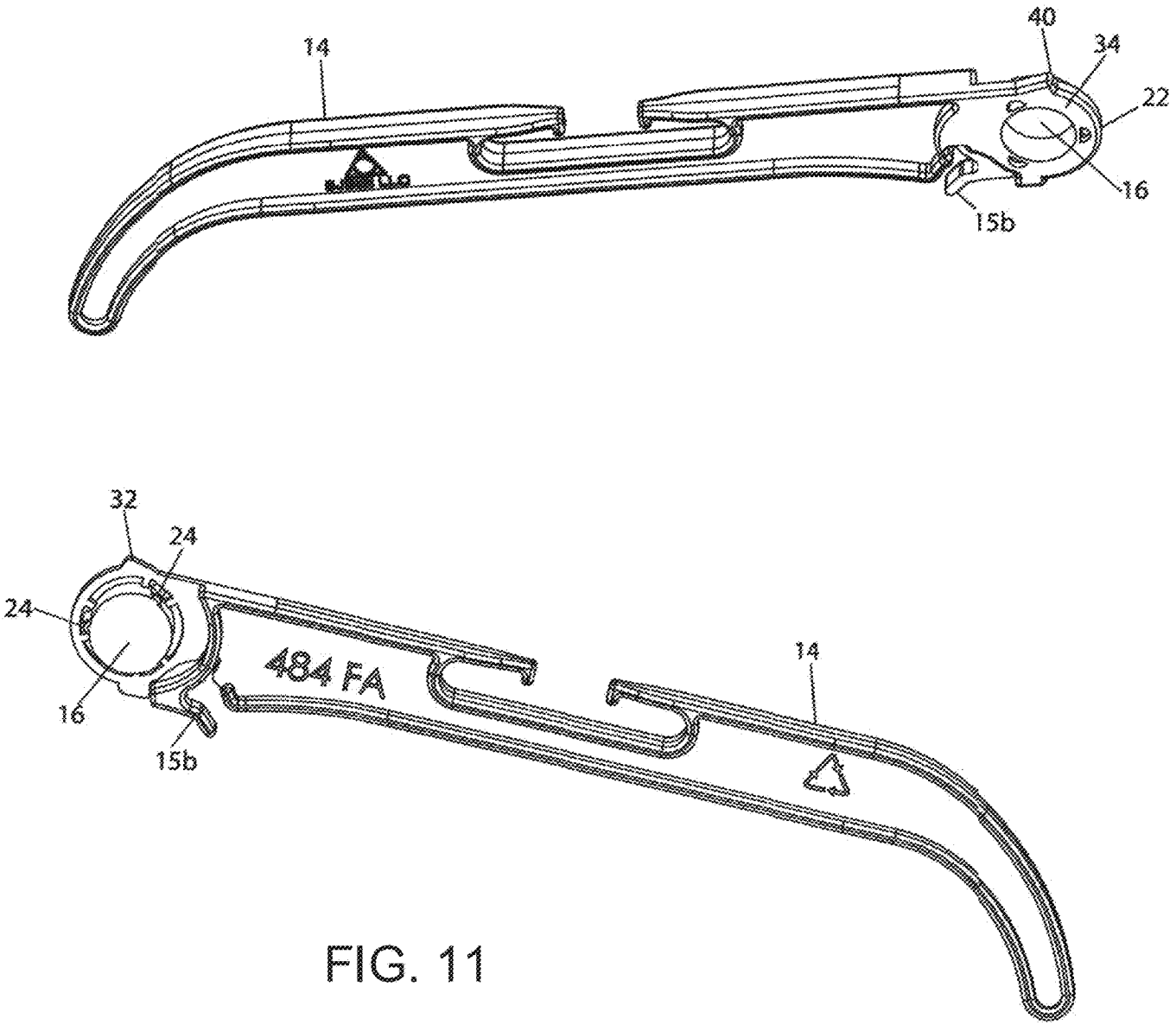
FIG. 11 is a perspective view of the collapsible arms.

FIG. 11 are front and back perspective views of arm 14 which can be used as right or left arms for the hangers. Hanger arm 14 has a substantially circular inner end of arm 22 with three retainer tabs 24 to hold arms to the central neck and hanger body formed on the back bearing surface 34. Also shown in FIG. 11 is flexible pinchable lock 15B when pinched releases the hold on arm stop 18B.

FIG. 12 shows the "collapsed" version of the arms.

As discussed above the collapsed state of the hanger provides a reduced footprint for the hanger creating space savings in packaging and transport and the inclusion of the flexible pinchable lock 15B and arm stop 18B allow for heavier weight garments. In order to save time and expense at the retail distribution center level, the hanger can either remain as a conventional hanger or the arm 14 can be collapsed for easy removal when hanger is not wanted in e-commerce use or when looking to save space in the dimensional packaging reducing the footprint of box and space required in shipping.

Figure 13:
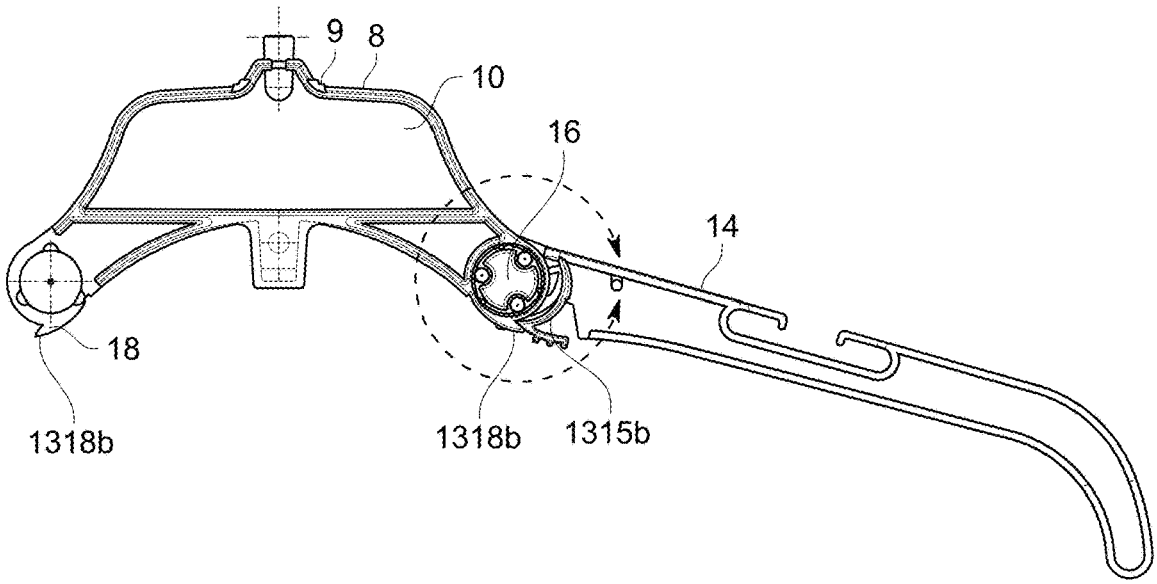
FIGS. 13, 13A and 13B include a perspective view of another pinch lock hanger of the present invention with collapsible arms and metal hook boss and enlarged views pertaining thereto, substantially similar to the hanger described relative to FIGS. 9 through 12, with modified stop and lock components.
Figure 13A:
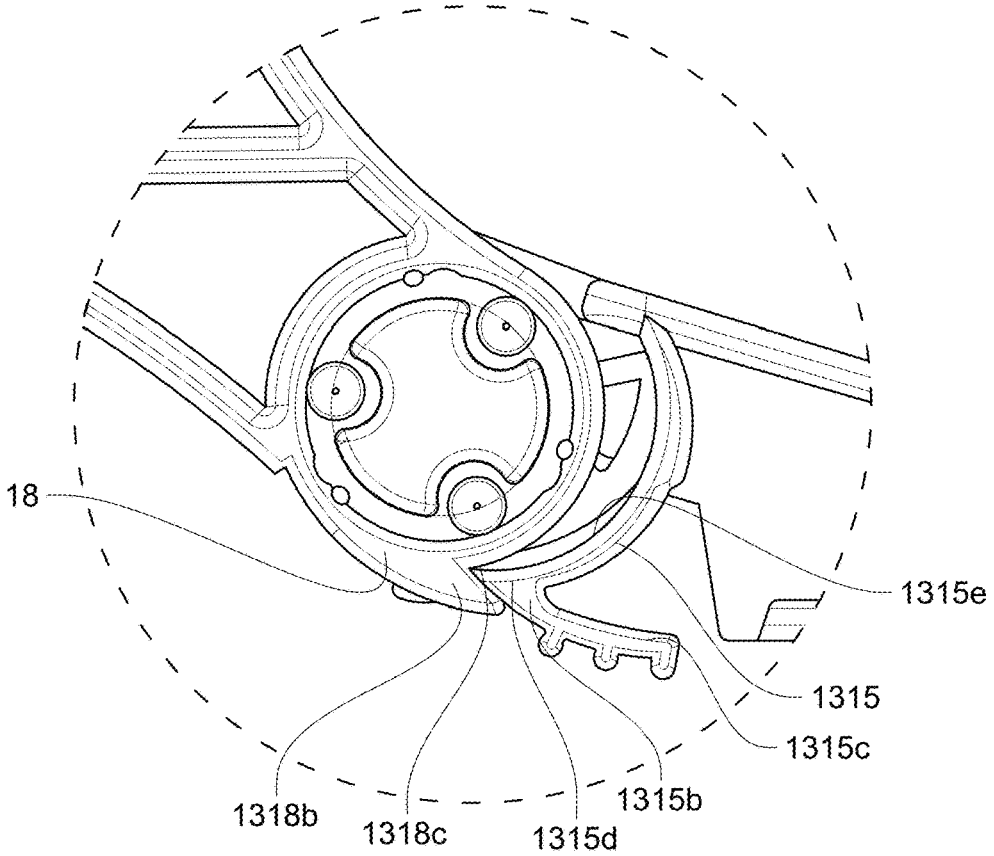
Figure 13B:
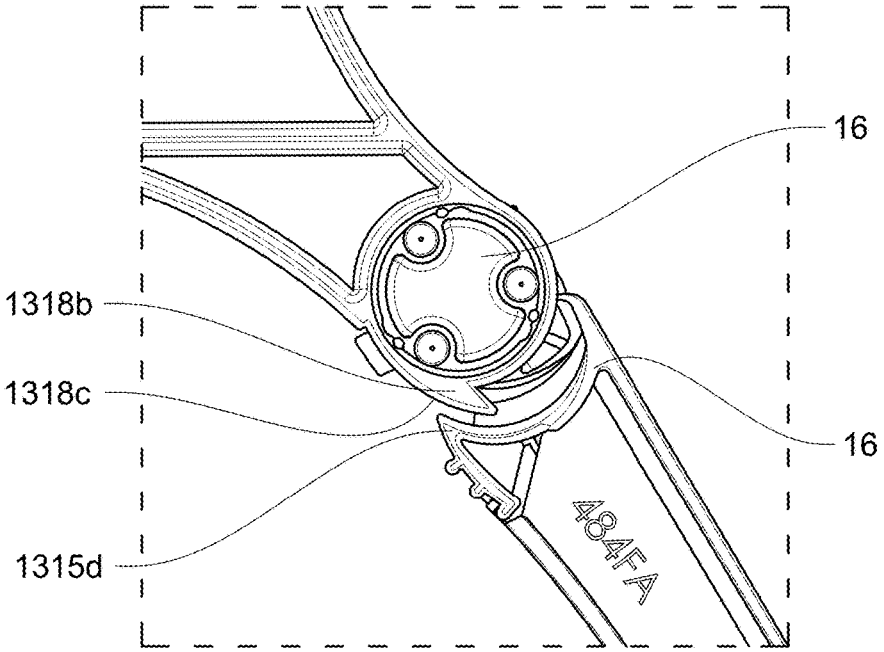

Referring to FIGS. 13, 13A and 13B, FIG. 13 shares virtually all of the elements of the embodiment of FIG. 9, including hanger 8 having central neck 10 and SOHS (secure over the hook sizer) sizer receiver mount 9 on side thereof. The hanger is preferably of an "I" beam construction. Hanger 8 is shown with only one of the two hanger arms 14 in the upright open standard horizontal position.

In accordance with this invention, arms 14 are pivotably connected to the central neck 10 at pivots 16 located on either side at the bottom of central neck 10. Here can be seen flexible pinchable lock 1315B, located at the distal end of an elongate, arcuate and flexible lock finger connected at its opposite end to and extending from the underside of the arm 14. When the handle 1315C of pinchable lock is pinched or pulled the lock 1315B is released from the arm stop 1318B, thereby enabling the arm to be moved to its collapsed, vertical orientation. The arm stop 1318B functions as a hanger arm arrester by arresting or blocking the ability of the extended hanger arm from returning to the collapsed position owing to excessive force exerted on the arm by a super heavy garment or due to an unintended jerking force applied to the arms. FIG. 13, which depicts the assembled hanger, shows one of the two pivotable arms 14 pivoted into the upright horizontal position to enable it to function as a conventional garment hanger for supporting and displaying a garment.

However, when the arms 14 need to be collapsed to enable the hanger to be removed from or inserted into a buttoned or closed neck garment, the cantilevered hangers arms 14 can be collapsed by pinching flexible pinchable lock 1315B which forces flexible pinchable lock 1315B to be free to rotate on pivot 16. Collapsible arms 14 employ a locking mechanism that allows for the arms to remain upright (horizontal) and "locked" into position for display but maybe easily folded or collapsed when they need to remove them form a closed neck garment or buttoned neck garment is required. The simplicity of the pivotable movement of the arms using flexible pinchable lock 1315B and releasing it from the locking position will be cost effective to manufacturers, easy to assemble and simple for pivoting the locking arm 14 in the upright or folded position.

The improved operation of the arm stop 1318B working together with the pinchable lock 1315B over the prior embodiment can be more easily appreciated from FIG. 13A, as it provides an enlarged view of the encircled section of FIG. 13. As shown, the hook 18 has a distal end that forms the "pointed" arm stop 1318B, which in turn defines a complementary shaped "nestling" space 1318C in which the similarly shaped distal end 1315D of the pinchable lock 1315B is tightly and snuggly received and locked, in the arms fully extended state of the hanger 8. When the arm 14 is being moved from the collapsed to the fully extended position, the tip of the stop 1318B slides on the interior surface 1315E of the lock. Even after extended and repeated use, the possibility of the plastic material of the tip of the "stop" wearing off is entirely negated. As in the prior embodiment, on can easily locate the extending arm 1315C of the lock 1315B and press on it inwardly to release it from the nestling space 1318C. Note that the arm 1315C protrudes and extends below the bottom surface or edge of the arm 14, whereby one can collapse the arm 14 even when it supports and rendered invisible by a garment hanging thereon. FIG. 13B is provided to illustrate the positions of the stop and lock in the intermediate position, when the hanger arm 14 is located about midway between being fully extended and collapsed.

As discussed above, as with the embodiment of FIG. 9, the FIG. 13 embodiment provides a reduced footprint for the hanger creating space savings in packaging and transport and the inclusion of the flexible pinchable lock 1315B and arm stop 1318B allow for heavier weight garments. In order to save time and expense at the retail distribution center level, the hanger can either remain as a conventional hanger or the arm 14 can be collapsed for easy removal when hanger is not wanted in e-commerce use or when looking to save space in the dimensional packaging reducing the footprint of box and space required in shipping.

Figure 14:
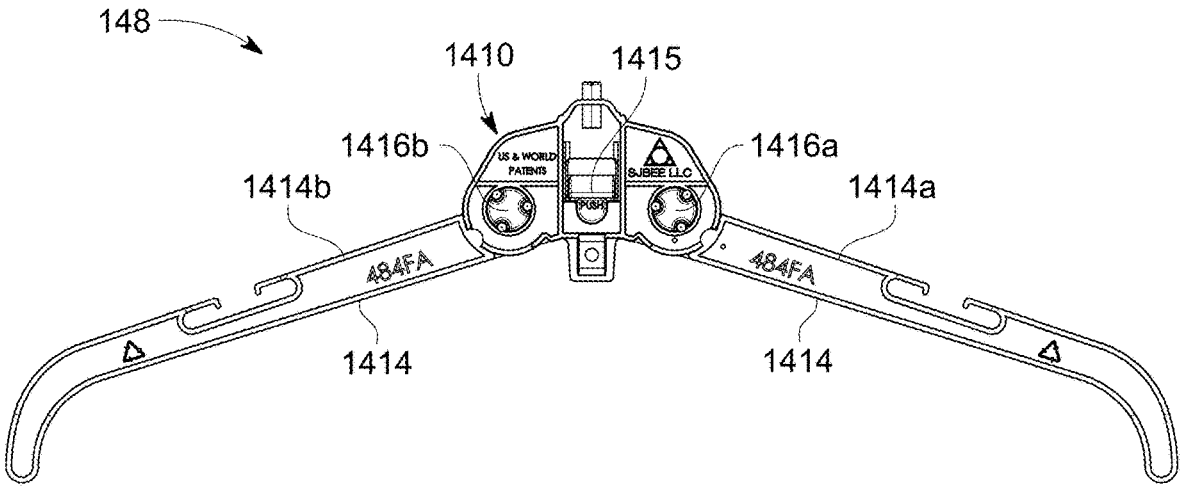
FIGS. 14, 14A and 14B include perspective views of another pinch lock hanger of the present invention with collapsible arms.
Figure 14A:
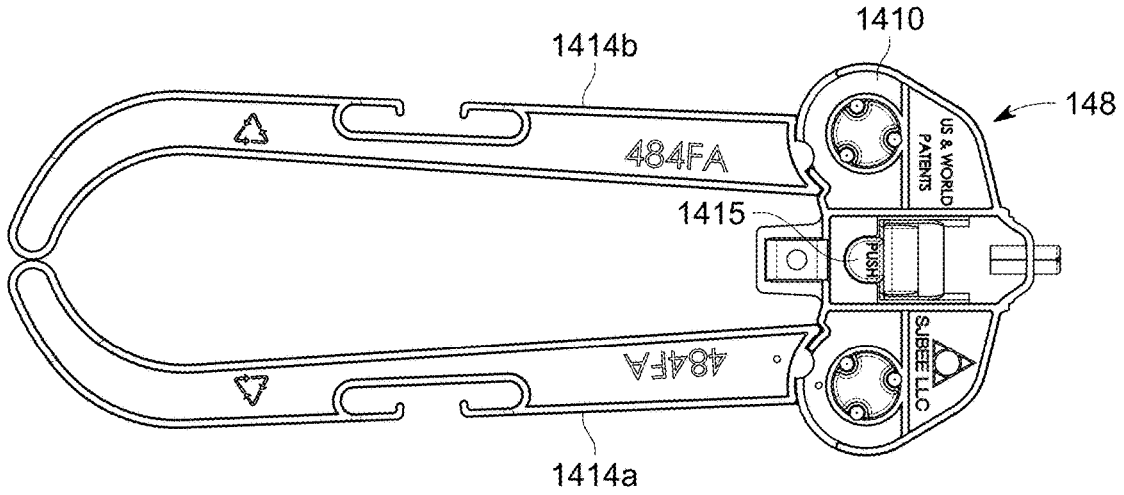
Figure 14B:
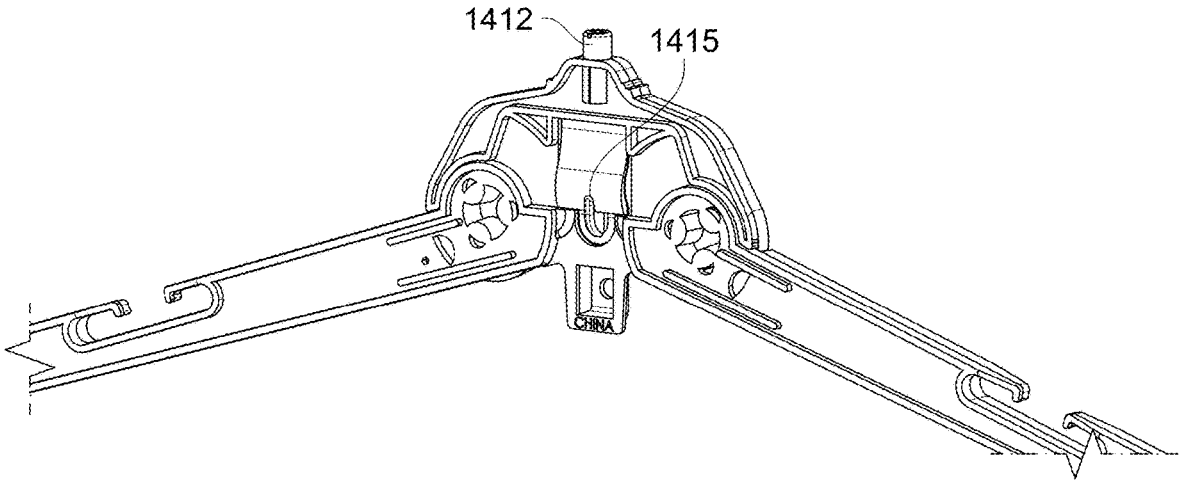

Reference is now made to FIGS. 14 through 16D that depict another preferred embodiment of the present disclosure of a hanger with collapsible arms. The hanger 148 depicted in FIGS. 14, 14A and 14B has a central body or shoulder or neck 1410 that removably receives and rotatably supports a pair of collapsible hanger arms 1414*a* and 1414*b*. The shoulder 1410 has a pair of circular pivot openings 1416*a*/1416*b*, for receiving therein pivoting nubs 14142 (FIG. 15B) as more fully described further on. A push button 1415 of the shoulder 1410 is configured/formed in a manner whereby the pressing in thereof releases the hanger arms from their operative, horizontally-extending orientation shown in FIG. 14 to their collapsed orientation shown in FIG. 14A. In FIG. 14*b*, the shoulder 1410 (and portions of the arms) are depicted from the rear view thereof. The metal hook receiver 1412 of the shoulder 1410 is similar to those described in the forgoing embodiments.

Figure 15A:
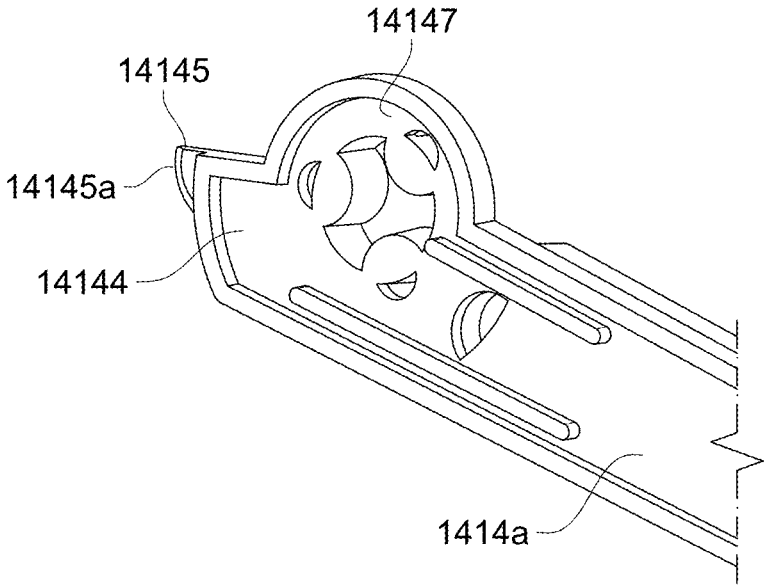
FIGS. 15A and 15B include perspective views of the pivot and locking structure portions of one of the collapsible arms of the hanger of FIG. 14.
Figure 15B:
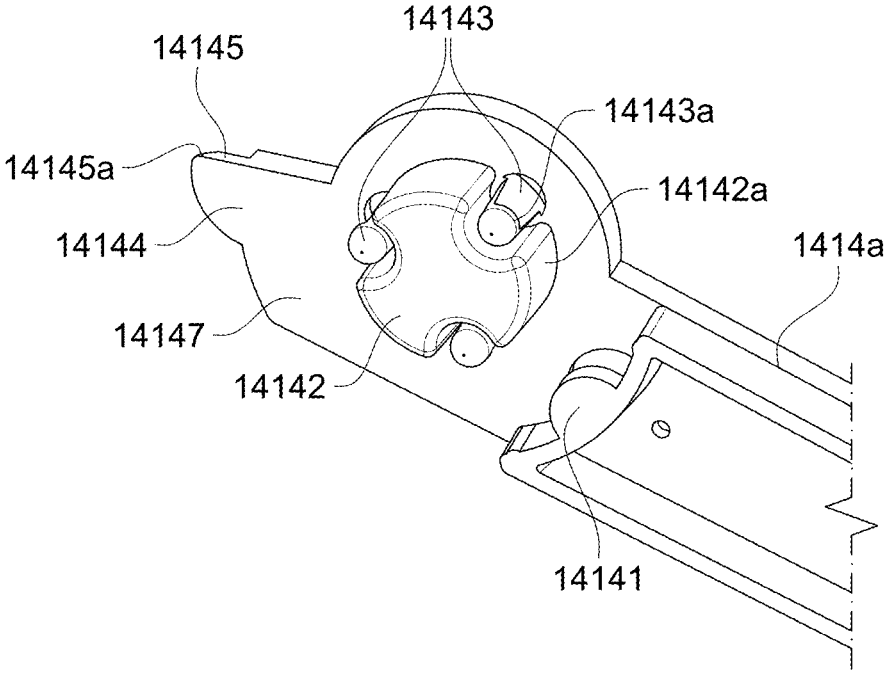

Referring now to FIGS. 15A and 15B, the operative portions of the (right) arm 1414*a* are illustrated from the rear thereof in FIG. 15A and from the front in FIG. 15B. Thus, the arm 1414*a* includes, at its distal end located away from the arm portion used for hanging clothing items, a base 14147 on which is formed a connecting nub 14142 formed with three arcuate projecting portions of which one is identified as 14142*a*. Together they define an outer diameter that enables the nub 14142 to be fittingly received in the pivot opening 1416*a* of the shoulder 1410, enabling the arm to rotatably move between extended arm position shown in FIG. 14 and the collapsed position depicted in FIG. 14A. The nub structure accommodates therein three resilient locking fingers 14143 each of which includes a detent 14143*a*, so formed that when the nub structure is inserted into the pivot opening 1416*a*/1416*b* of the shoulder 1410, the detents catch the top end of the pivot opening round wall 14101 (FIG. 16C). Thereby, the hanger arms are mechanically secured to the shoulder 1410, in a manner that still permits rotation relative thereto.

With further reference to FIG. 15B, the hanging arm 1414*a*/1414*b* also includes an arm stop 14141 that serves to limit the rotation range of the arm relative to the shoulder 1410, so that (as shown in FIG. 16C) counter-clock motion of the hanger arm 1414*a* is arrested when the arm stop 14141, moving in the channel 14102, abuts the channel's end 14102*a*, and similarly, clockwise rotation is arrested when the stop 14141 abuts the opposite channel end 14102*b*.

Ordinarily, owing to the force of gravity, the hanging arms 1414*a/b* would tend to fall to their collapsed positions. Therefore, to firmly support the arms 1414*a/b* at their extended positions, the present invention provides for each of these arms a hooking structure which for the arm 1414*a* is illustrated in FIG. 15B to include a jutting out hook 14144 having generally the thickness of the element 14147, from which hook extends a narrowed thickness hooking finger 14145 whose tip 14145*a* gradually narrows in thickness for a purpose explicated further on. This arm hooking structure is configured to interact with the aforementioned push button 1415 of the shoulder 1410. The FIG. 15A depicts the arm hooking structure from the rear view thereof.

Figure 16A:
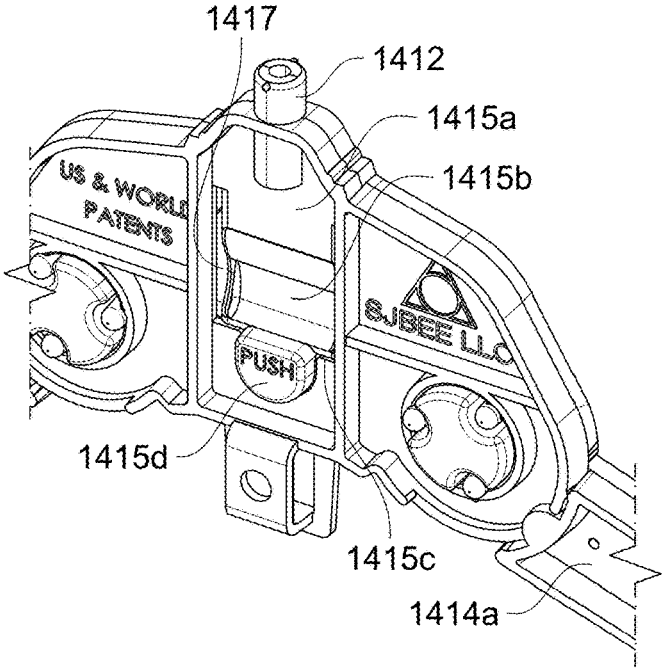
FIGS. 16A, 16B, 16C and 16D include perspective views of the central body, i.e., the central shoulder, of the FIG. 14 hanger, which supports the collapsible arms of the hanger.
Figure 16B:
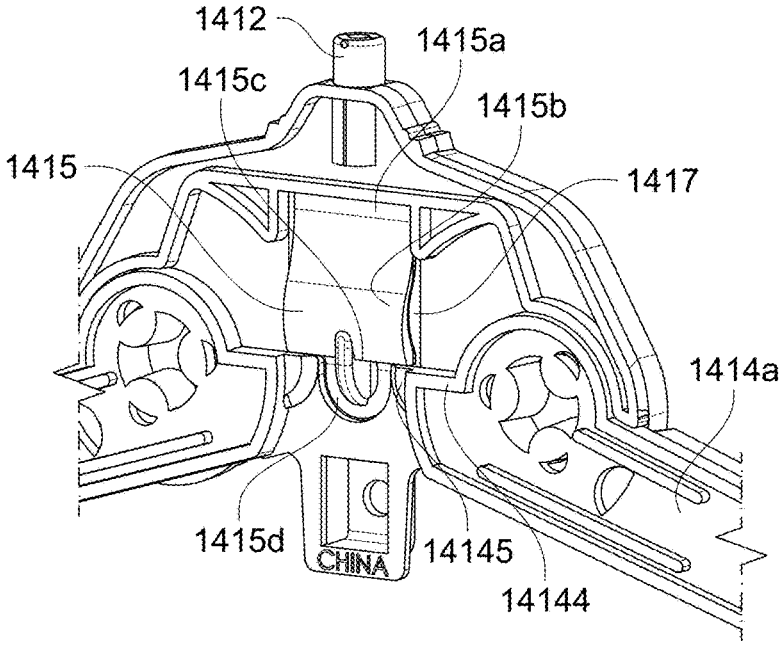
Figure 16C:
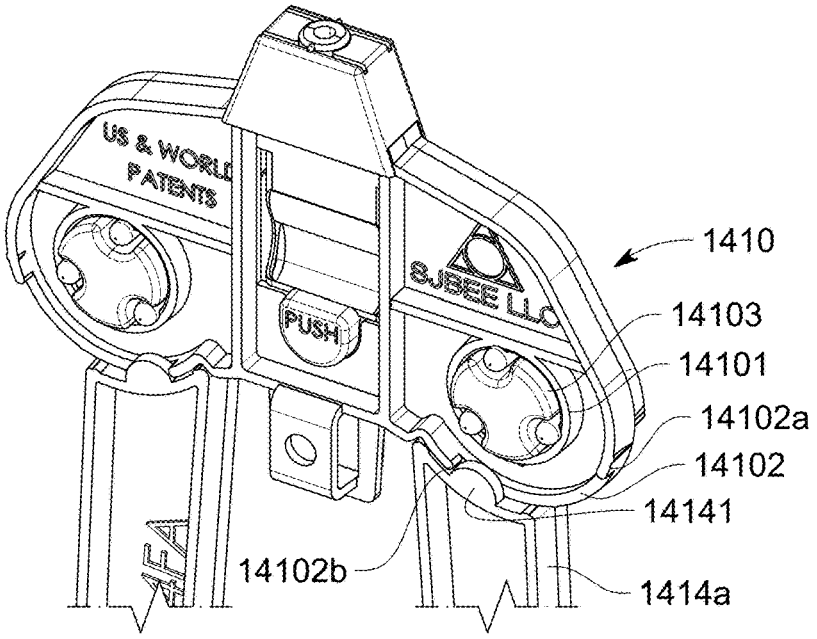
Figure 16D:
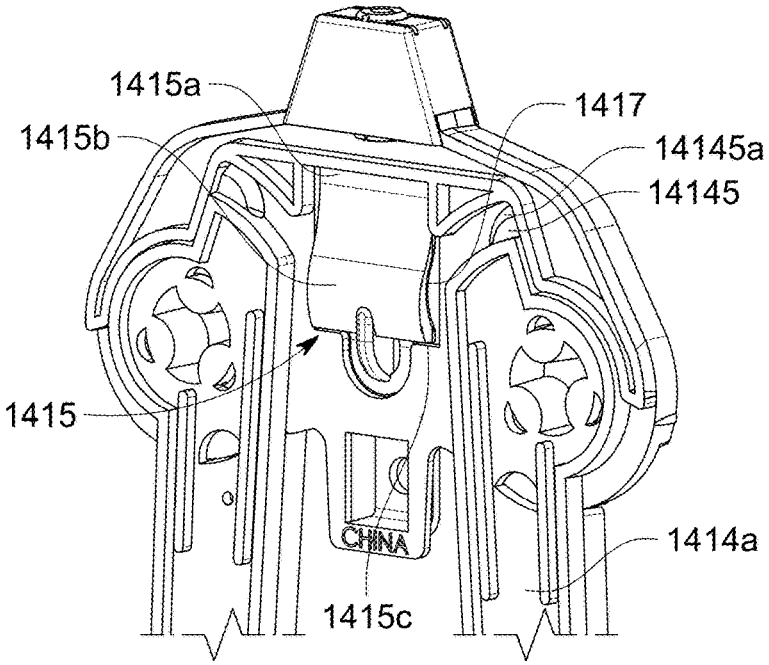

The manner in which the arms' hooking structures interact with the push button 1415 to become locked in their extended positions can best be understood by jointly viewing FIG. 16B (arms in extended position) and FIG. 16D (arms collapsed). Referring first the push button 1415, its overall structure can gleaned from the FIG. 16A (front view) and FIGS. 16B and 16D (rear view) showing button connection 1415*a* to the shoulder 1410, a midsection arcuate portion 1415*b* and a distal bottom end 1415*c*. The button portion 1415*d* is sized and shaped to be easily engaged and pushed in by a user's finger or the like. Also note that the arcuate shape of the midsection 1415*b* leaves a gap or space 1417 for the purpose explicated immediately below.

Turning again to FIG. 16D, the hooking finger 14145 of the (collapsed) arm 1414*a* is shown in a position pointing upwards and locate away from the push button 1415. However, when a user grasps the arm 1414*a* and rotates it counter-clockwise, the hooking finger 14145 approached the gap 1417, allowing first its reduced thickness portion 14145*a* to enter the gap 1417 and gradually push the entire button structure to yield until the finger 14145 rotates past and below the push button. At this position, the push button snaps back to its unbent position, which causes the finger 14145 to engage the tip end 1415*c*, thereby being blocked from returning to the collapsed arm position. The only way to release the arm is by pushing on the knob 1415*d*. Thereby, the arm 1414*a*, and similarly the arm 1414*b*, can be firmly secured in their extended positions. In general, the hanger embodiment described with reference to FIG. 14 et seq. can have any or several of the other hanger features described relative to the other embodiments illustrated in the other figures referenced above.

In general, the collapsible hangers described in the present inventors' issued patents relied on frictional forces between lock and nub components, and use of snap into detents, to hold the arms of the hangers in their extended positions. The arms could be forced down, into their collapsed positions by applying a torque force that caused the plastic lock and nub components to plastically deform and thereby be forced to the down positions. In marked contrast, in the embodiments of the present inventions employ different locking components located outside the interior of the pivot to positively inter-engage and interlock the various stop and lock components in a manner that does not rely on the frictional forces and plastic deformation to effect the locking of the in their extended orientations. Rather, the flexible lock components include a "pinchable" or "pull-able" extension, that preferably extends below the lower edge of the arms, and which can and must be pinched or squeezed or pulled to release the lock component from being firmly grasped and held by the stop. Without this pinching action, the arms remain firmly lock, unable to being bent down to the collapsed position.

In addition, the present inventions realize the objective of positive locking and holding of the arms through the use of only three injection molded piece, namely the center piece and the two arms. The center piece if formed with the above-described pivot cavity in which is received and supported a respective one of the arm, with the arm and center piece having molded therein all the features that form the lock and stop components described above without resorting to any additional pins, or levers or the locking to realize the improved hanger construction described above. Also, all the hanger embodiments described above meet the requirements of GS1: Guideline Hanger Specifications for Floor-Ready Merchandise for hangers including for parameters such as weight, distortion, materials and the like. Regardless, preferably, the hangers herein are suited to support garments weighing at least two pounds.

It should be understood that the preferred embodiment was described to provide the best illustration of the principles of the invention and its practical application to thereby enable one of ordinary skill in the art to utilize the invention in various embodiments and with various modifications which are within the suited to the particular use contemplated. All such modifications and variations are within the scope of the invention are deemed by the appended claims when interpreted in accordance with the breadth to which they are fairly legally and equitably entitled.

LIST OF PARTS

6 metal hook
8 Hanger
9 Steps for SOHS size identity tab
10 Central neck
11 Coordinate loop for metal hook
12 Hook and Sizer mount for folding metal hook
13 Plastic hook sizer mount
14 Hanger Arms
15 Flexible stabilization mechanism
15A flexible pull in lock
15B flexible pinch lock
16 Pivots
17 Stabilizing nub for 15
18 Plastic Hook
18A Arm stop
18B Arm Step stop
19 Metal Hook Boss
20 Circular projection
21 Cantilevered Projection
22 inner end of hanger arm
24 Retainer tab
26 Radial surface of circular cantilevered projection
28 Cantilevered positioning nub
29 Cantilevered Flexible member
30 Hole
32 Recess
34 Back bearing surface
36 Perimeter around hole 30
38 Recess for nub 28
40 Upper arm stop
42 Lower arm stop
44 Central head arm stop
46 Projection nub
48 Cylindrical projection
1315 Flexibly extending lock support finger
1315B Modified flexible pinch lock
1315C Extended arm

1315D Distal end
1315E Interior surface of lock
1318B Modified arm stop
1318C Lock nestling space
148 Hanger
1410 Shoulder
1412 Metal hook receiver
1414 Arms
1414*a* Right arm
1414*b* Left arm
1415 Push button
1415*a* Button connection
1415*b* Midsection portion
1415*c* Distal bottom end
1415*d* Button Portion
1416*a* Right pivot opening
1416*b* Left pivot opening
1417 Gap
14101 Opening Round wall
14102 Channel
14102*a* Channel end
14102*b* Opposite channel end
14103 Projecting portions
14141 Arm stop
14142 Connecting nubs
14142*a* Connecting nub
14143 Locking fingers
14143*a* Locking fingers detents
14144 Hook
14145 Hooking fingers
14145*a* Tip of hooking fingers
14147 Base Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A garment hanger, comprising:

a hanger body having a central neck, formed as a single molded piece, with a configuration to receive a hanger hook, and hanger arms connectible to said central neck such that said hanger arms are rotatable to assume an extended position suitable for supporting a garment thereon and a collapsed position permitting the hanger to be removed from or inserted into a garment through a neck opening of the garment, without having to unbutton said garment for such removal;

said hanger body comprising a pair of pivot openings at opposite ends of said central neck, and a user-actuatable, integrated, resiliently movable push button located generally between said pivot openings and said push button is integrally connected at only one side thereof to said central neck;

said hanger arms including a first hanger arm and a second hanger arm, each hanger arm being connectible to and pivotably movable in a respective one of said pivot openings, in configurations that enable said hanger arms to be selectively moved between said extended and collapsed positions; and each hanger arm being formed as a single molded piece and being molded to include a nub sized to snuggly fit and rotate within one of said pivot opening and to include a hooking finger configured to inter-engage said push button in a manner that locks said hanger arm in the extended position and being releasable upon actuation of said push button, whereby the central neck and the hanger arms are comprised of only three molded pieces inter-fitted with each other.

2. A garment hanger as described in claim 1, wherein the nub comprises locking portions that are insertable into a respective one of said pivot openings from one side of said hanger body and emerge from said respective opening on an opposed side of said pivot opening to engage the pivot opening in a manner that locks the nub to the central neck.

3. A garment hanger as described in claim 2, wherein said locking portions comprise a plurality of locking fingers.

4. A garment hanger as described in claim 2, including a hanger hook that is pivotably moveable to either substantially vertical or horizontal positions.

5. A garment hanger as described in claim 4, wherein said central neck comprises a pivot for said hanger hook.

6. A garment hanger as described in claim 1, wherein each of the hanger arms is formed of a single injection molded plastic piece.

7. A garment hanger as described in claim 1, wherein each said hanger arms comprises a stop that limits the rotational movement range thereof relative to said central neck.

8. A garment hanger as described in claim 7, wherein the central neck comprises a channel for movement of said stop therein.

9. A garment hanger as described in claim 1, wherein the hanger arms are configured to remain in their extended orientations even when supporting garment weights of two pounds.

10. A garment hanger as described in claim 1, wherein the hooking finger comprises a tip of gradually reducing thickness that is configured to engage an arcuate portion of said push button, to displace it and enable the hooking finger to engage a bottom edge of the push button to thereby lock the hanger arm in the extended orientation.

11. A garment hanger as described in claim 1, including a hanger hook pivotably connected to said hanger neck and moveable to either substantially vertical or horizontal positions.

12. A garment hanger as described in claim 11, wherein said central neck comprises a pivot for said hanger hook.

13. A garment hanger as described in claim 1, wherein all components of said hanger are molded.

14. A garment hanger as described in claim 13, wherein said hanger is molded plastic.

15. A garment hanger as described in claim 1, including said hanger hook mounted to said central neck.

* * * * *